US007156714B2

(12) United States Patent
Kian et al.

(10) Patent No.: US 7,156,714 B2
(45) Date of Patent: Jan. 2, 2007

(54) SURFER LIFT SYSTEM

(75) Inventors: Kianoush Kian, Tempe, AZ (US); Max R. Foroudi, San Pedro, CA (US); Sean F. Anderson, Tucson, AZ (US)

(73) Assignee: MKS Enterprises, LLC, Gilbert, AZ (US)

( * ) Notice: Subject to any disclaimer, the term of this patent is extended or adjusted under 35 U.S.C. 154(b) by 0 days.

(21) Appl. No.: 11/144,342

(22) Filed: Jun. 3, 2005

(65) Prior Publication Data

US 2006/0166575 A1 Jul. 27, 2006

(51) Int. Cl.
*B63B 35/81* (2006.01)

(52) U.S. Cl. ..... 441/74; 104/173.1; 472/13

(58) Field of Classification Search ..... 114/242; 441/74; 104/173.1, 173.2; 472/13
See application file for complete search history.

(56) References Cited

U.S. PATENT DOCUMENTS 3,052,470 A * 9/1962 Pomagalski ..... 472/13
3,181,861 A 5/1965 Wilkinson ..... 272/32
3,376,829 A * 4/1968 Hancock ..... 104/173.2
3,486,463 A 12/1969 St. Cyr ..... 104/173
3,538,855 A 11/1970 St. Cyr ..... 104/173
3,743,278 A * 7/1973 Rixen ..... 472/13
4,246,848 A * 1/1981 Schneider ..... 104/173
4,353,307 A 10/1982 Munson ..... 104/183
4,523,525 A * 6/1985 Foster ..... 104/173
5,562,040 A * 10/1996 Egli ..... 104/173.1

OTHER PUBLICATIONS

Website printout, http://www.towsurfer.com/towin.asp, copyright 2002-2005.

* cited by examiner

*Primary Examiner*—Lars A. Olson
(74) *Attorney, Agent, or Firm*—Louis J. Hoffman; Edwin A. Suominen

(57) ABSTRACT

A rider is suspended a distance beneath a lift cable and moved over a region of water with incoming waves. The distance that the rider is suspended beneath the lift cable is controllably increased and, thereafter, the rider enters the water, such as to surf the waves. The rider can control the increase in distance individually, lowering himself or herself at will after spotting a desirable place to enter the water, e.g., just after the crest of an incoming wave. The initial distance, i.e., the distance below the cable before the rider is lowered toward the water, can be set to carry the rider high enough to pass over the crests of the waves. Various other aspects, apparatus, and variations are also disclosed.

20 Claims, 5 Drawing Sheets

SURFER LIFT SYSTEM

BACKGROUND OF THE INVENTION

In the sports of skiing and surfing, the rider must move against the natural forces of gravity or incoming wave action to reach a point where he or she can harness those natural forces to ride down a hillside or along the face of a wave. Few skiers would consider engaging in their sport without the benefit of powered lifts to overcome gravity and start their runs high up on the hillside. Despite the long-standing availability of several expired patents that teach offshore towing systems, most surfers still rely on paddling and rip currents to reach desirable offshore locations for riding incoming waves.

For example, U.S. Pat. No. 3,181,861 to Wilkinson discusses a system for installation at beaches to allow riders to be carried on tow bars along the surface of the water to an offshore location. Another system, discussed in U.S. Pat. No. 3,486,463 to St. Cyr, includes shorter support towers at loading and unloading stations for allowing riders to mount and dismount tow bars. In this manner, the cable is at a lower height nearer the water when a rider reaches the offshore location. At that point, the rider may jump into the water with his board.

For offshore towing systems to see widespread usage, significant improvements still appear needed. Particularly desirable would be increased flexibility to accommodate a wide range of surfing conditions and varying skills and interests of riders.

SUMMARY OF THE INVENTION

In a method of the invention, a rider is suspended a distance beneath a lift cable and moved over a region of water with incoming waves. The distance that the rider is suspended beneath the lift cable is controllably increased, independently of how other riders are suspended at different locations beneath the lift cable. Thereafter, the rider enters the water. The rider can control the increase in distance, lowering himself or herself at will after spotting a desirable place to enter the water, e.g., just after the crest of an incoming wave.

The initial distance, i.e., the distance the rider is suspended below the cable before any lowering toward the water, can be set to carry the rider high enough to pass over the crests of the waves. In some embodiments, the distance at which the rider is suspended beneath the lift cable can also be decreased independently of other riders, so that an individual rider can move higher up and better clear the crests of larger-than-expected incoming waves.

The above summary does not include an exhaustive list of all aspects of the present invention. Indeed, the inventor contemplates that the invention includes all systems and methods that can be practiced from all suitable combinations of the various aspects summarized above, as well as those disclosed in the detailed description below and particularly pointed out in the claims. Such combinations have particular advantages not specifically recited in the above summary.

DESCRIPTION OF PREFERRED EXEMPLARY EMBODIMENTS

Figure 1:
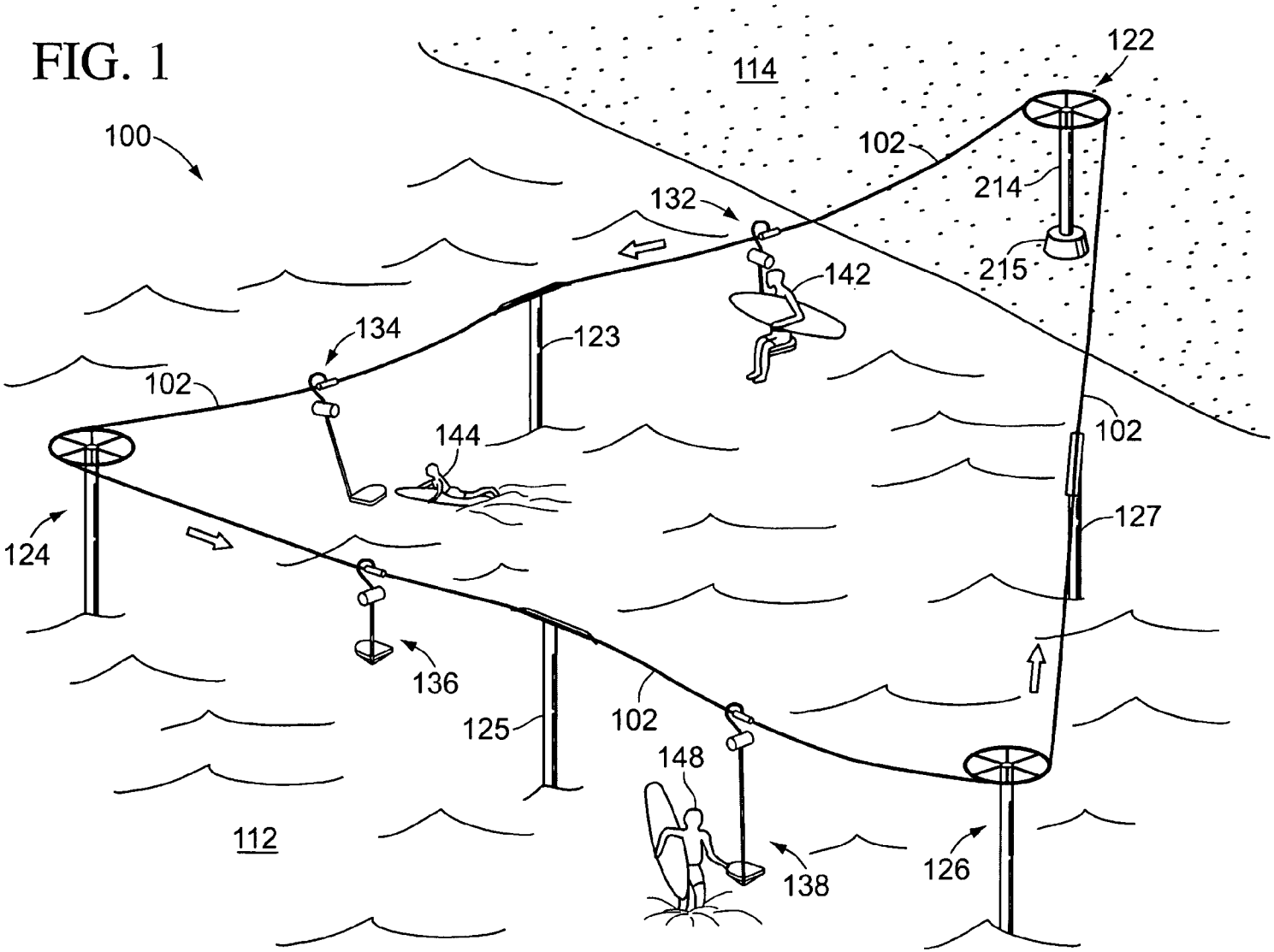
FIG. 1 is a perspective view of one embodiment of a surfer lift system, showing various aspects of the invention.

A surfer lift system according to various aspects of the present invention is illustrated in the figures. FIG. 1 illustrates an exemplary system 100 including a lift cable 102 that circulates in a continuous loop between opposing support pylons 122, 124, 126 and extends partially over a region of water 112 near a beach 114. Pylon 122 stands on beach 114 with its mast 214 anchored in a concrete block 215 deep enough and securely enough beneath the surface of beach 114 to counter tension in cable 102. Opposing pylons 124, 126 extend above water 112 from bases (not shown) similarly anchored in the seabed beneath water 112. Intermediate support pylons 123, 125, 127 limit sag and tension on lift cable 102 between pairs of opposing support pylons. Alternatively, pylon 122 can be placed just offshore or formed in conjunction with a pier or other shoreline structure.

Rider supports 132, 134, 138 connect to lift cable 102 and suspend riders 142, 144, 148 from cable 102. System 100 also includes rider support 136, which is depicted in FIG. 1 without any rider on it, and preferably other rider supports not shown. The rider supports are attached to points suitably spaced along cable 102, e.g., preferably at regular intervals and with enough separation between them to ensure that one cannot swing backward and hit a rider on the one behind it.

There may be any appropriate number of rider supports, as readily determined by those of skill in the art of such lifts. System 100 also may include one or more embarkation stations (not shown), such as near pylon 122 on beach 114 or just offshore in the shallow part of water 112, such as on or connected to a pier or using floating or fixed platform. The embarkation station may include crowd control features of known design, such as turnstiles, walkways, pay points, etc. Alternatively, riders can embark directly off of beach 114.

The rider supports of exemplary system 100 advantageously permit a rider to controllably lower the point of support at which he or she is suspended beneath lift cable 102. Ignoring cable sag or tilt, this point would correlate with the elevation of the point of support. As may be better understood with reference to FIG. 3, for example, rider support 134 includes a housing-enclosed winch 320 that suspends a seating platform 340 from cable 102 via a variable length of vertical suspension cable 330 and mast 342. Winch 320 suspends from lift cable 102 via a fixed length of rigid, bent support tubing 310, which is fixed to cable 102 by pressure sleeve 312. As in conventional ski lifts, and with the same potential variations in structure, tubing 310 leaves some clearance at points around cable 102 for it to pass over support rollers and wheels of pylons 122–127.

Tubing 310, cable 330, and mast 342 should all be of sufficient thickness and material strength to support the weight of the heaviest expected rider and surfboard, with considerable safety margin. The same consideration applies to mechanical connections between those structural components as well as to winch 320 and seat 346.

Figure 4:
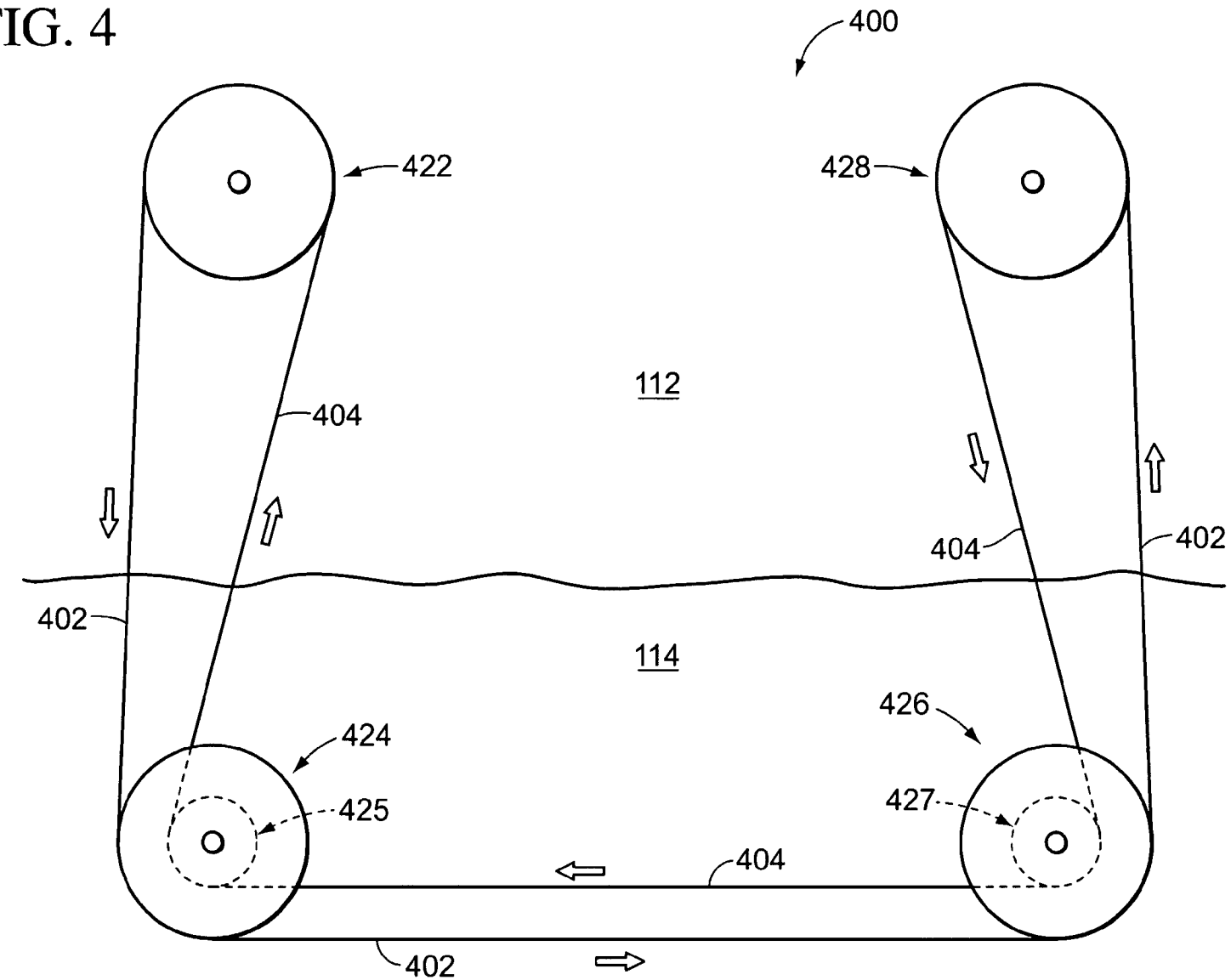
FIG. 4 is a top view of another embodiment of a surfer lift system with four opposing pylons and a tightly circulating loop of lift cable.

System 100 alternatively can include just two pylons, or more pylons not shown in FIG. 1. For example, FIG. 4 illustrates a system 400 with four opposing pylons. System 400 (not to scale) includes a tightly circulating loop of lift cable with an first segment 402 that is at a different elevation than a second segment 404. The loop circulates from between two offshore pylons 422, 428, located in FIG. 4 in water 112, which act as the ends of the loop. Intermediate opposing pylons 424, 426 constrain the cable to run along beach 114.

In an alternative configuration that is a modification of system 400, the location of beach 114 and water 112 is reversed, such that the cable moves around a pair of outer (offshore) pylons 422, 428, which act as ends of the loop, and opposite sides of the looped cable move in opposite directions as they pass each of inner (onshore or near-shore) pylons 424, 426. This alternative configuration has the advantage of allowing the riders to enter the water at various places along the shoreline between pylons 424 and 426.

System 400, in the configuration shown in FIG. 4, with segments 402 and 404 running in both directions along (or near) beach 114, allows for embarkation at multiple points along the beach, decreasing the need for riders to walk long distances along beach 114 (with surfboards) to re-embark. If the waves bring a surfer who enters the water near pylon 422 to shore closer to pylon 426, for example, he or she can use the ride option provided by segment 404 to return to an embarkation point near pylon 424, without having to walk all the way back to pylon 424. The system 400 of FIG. 4 also has the advantage of permitting riders to proceed out into water 112 in two locations, first, from an embarkation point near pylon 424, to enter the water near pylon 422, using segment 404, and second, from an embarkation point near pylon 426, to enter the water near pylon 428, using segment 402.

Figure 5:
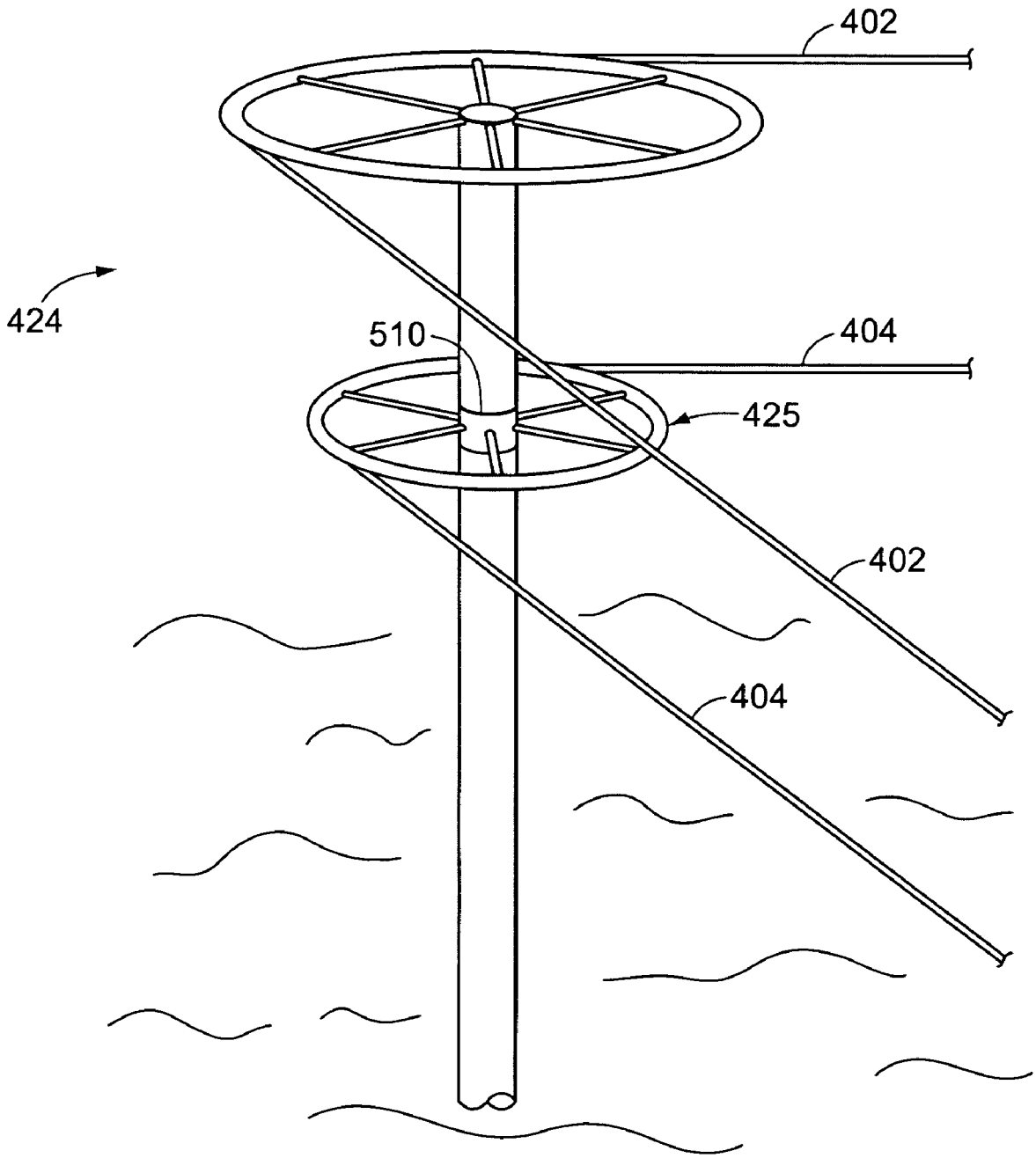
FIG. 5 is a perspective view illustrating one of the pylons of the system of FIG. 4.

Intermediate opposing pylons 424, 426 have similar structure, which may be better understood with reference to the illustration of pylon 424 in FIG. 5. Pylon 424 includes a wheel at its top, similar in structure to driving wheel 212 of pylon 122 (FIG. 2), which routes segment 402 of the lift cable around it in a first direction. (Torque, e.g., from a driving motor not shown, may or may not be applied.) Pylon 424 also includes another wheel 425 that is supported on a hub 510 partway along the length of pylon 424 and that routes segment 404 of the lift cable around pylon 424 in the opposite direction. The wheels are preferably of different diameters, sufficient to allow seating platforms to pass each other in opposite directions with sufficient distance between them to allow sufficient clearance between riders or their equipment passing in different directions.

Any suitable type of seating platform can be employed as a point of support for a rider to be suspended from a lift cable in accordance with various aspects of the invention. Exemplary seating platform 340 includes a seat 346 connected to mast 342 near one end and stiffeners 352, 354 beneath seat 346 to strengthen the connection. Having a single support point for seat 346 advantageously maximizes flexibility in how a rider can dismount from it.

Preferably, seat 346 is of lightweight construction and has a generous amount of padding extending around its sides. Those considerations are not merely to increase comfort of riders on seat 346. When seat 346 is in a lowered position, light weight (preferably even to the point of buoyancy) and padding also reduce the injury risk associated with seat 346 swinging around near the surface of the water or becoming a submerged, hidden hazard. Bright, fluorescent colors can also be used for improved safety.

Mast 342 provides a rigid part for the suspension structure between seat 346 and winch 320. The rigidity of mast 342 provides riders with a stable hand grip and avoids any possibility of dangerous cable loops around their arms and legs. Mast 342 includes a descent control 344, preferably waterproofed, which a rider can manipulate by squeezing. The switches or interface for descent control 344 can be of any suitable form, including one or more buttons or knobs, with or without speed control, covered or not, and powered or not.

Additional user controls (not shown) can be included on mast 342 for raising seating platform 340, forcing circulation of lift cable 102 to stop (such as in an emergency), or notifying an operator of system 100 that a hazard condition is present. If a control permits raising platform 340, it can be the same or a different control as descent control 344. In other words, descent control 344 can be unidirectional or bidirectional.

A control device (not shown) can be included to automatically raise platform 340 when the rider disembarks, which is especially useful in embodiments where no user control is provided for raising seating platform 340. One example of such a device includes a weight sensor mechanically coupled to cable 330 and configured to activate winch 320 to wind up cable 330 when the weight falls below a certain threshold. To give the rider a chance to move clear of seating platform 340, the device can ensure that a desired delay time elapses before it activates winch 320.

Various mechanisms can be used for riders to reach the height of the seating platforms at embarkation. In one variation, there can be a fixed platform that is suitably accessible, e.g., by stairs, a ladder, or an elevator. For example, system 400 of FIG. 4 can include various structure (not shown) to accomplish that goal, including a fixed platform station at pylon 422 or pylon 428, or at both locations. Alternatively, a given seating platform can be lowered, e.g., by a trigger or spring-loaded hook mechanism at pylons 422, 428, to a suitable height for embarkation when approaching a person desiring to ride it. The heights of pylons also can be controlled with reference to any embarkation platform to allow the seating platforms to pass the embarkation station at the proper elevation.

Winch 320 is driven by an electric motor inside the winch's housing. Power for the motor can come from a battery, which can be located inside the housing or through power lines incorporated in cable 102 and running through tubing 310 (or, with appropriate insulation, through the cable and tubing directly). If safety concerns are not overriding for the particular application, e.g., a desire to minimize weight and consequent impact danger of platform 340 to people in water 112, a battery for powering the motor of winch 320 can also be located below seat 346. Wiring suitable for conducting power from a battery in that location to winch 320 can pass through suspension mast 342 and cable 330.

Figure 2:
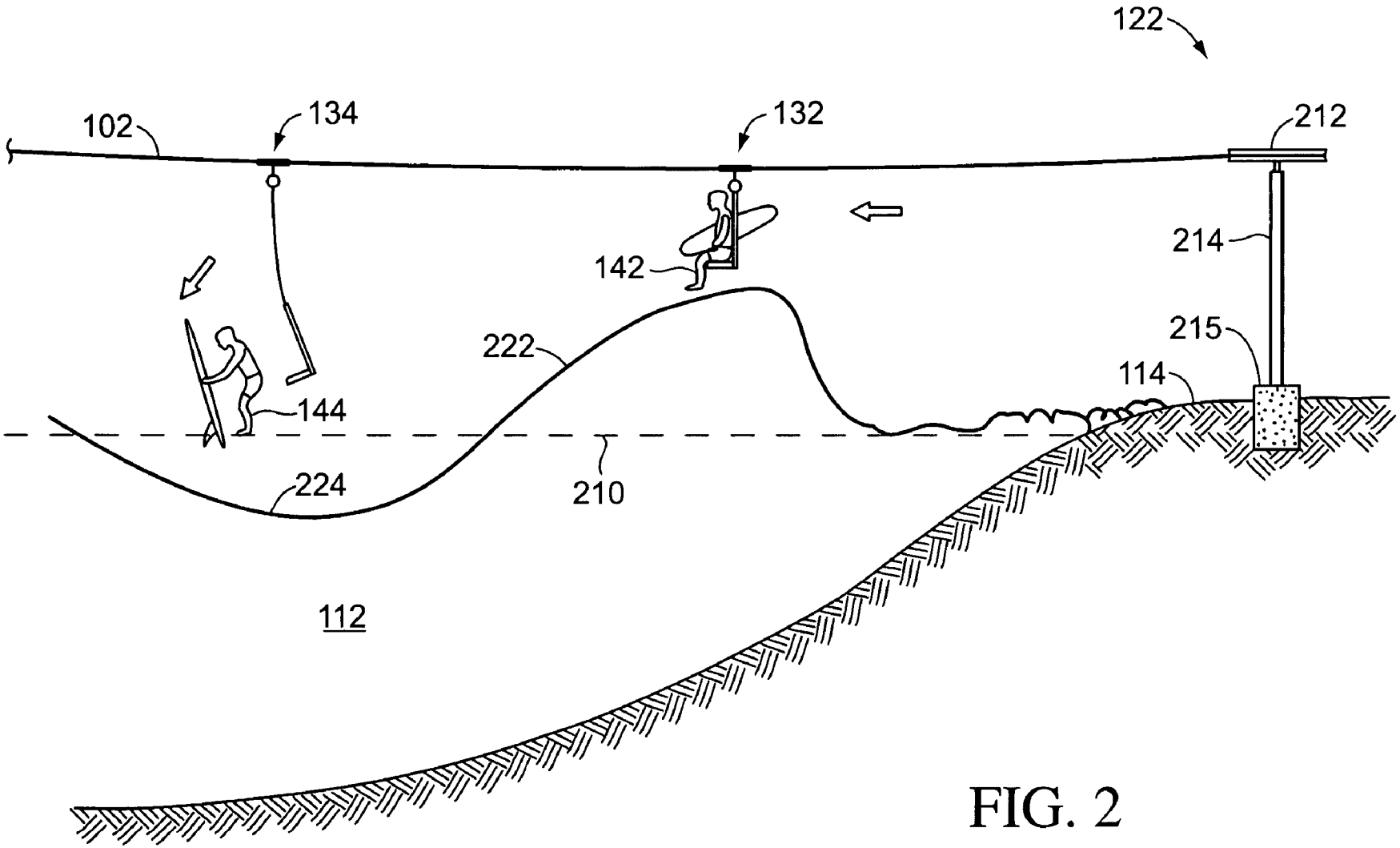
FIG. 2 is a side view of a portion of the system of FIG. 1.

FIGS. 1–2 illustrate two important points of operation of system 100, for different riders 142, 144. Rider support 132 suspends rider 142 beneath lift cable 102 at a point of support high enough to pass over a wave crest 222 (FIG. 2). Rider 144 has lowered his point of support (seating platform 340, FIG. 3) to dismount from it and enter the water at a wave trough 224 (see FIG. 2). To allow more time for mounting a surfboard before arrival of the next wave crest, a different rider may have chosen to dismount from his or her rider support closer to wave crest 222 than rider 144 has chosen.

FIG. 1 illustrates another rider 148 in the process of dismounting from rider support 138. Rider 148 has chosen to dismount on the second leg of lift cable 102 between opposing pylons 124, 126 rather than the first leg between opposing pylons 122, 124 where rider 144 has dismounted. The first leg is primarily to build distance from the shoreline, and some riders may choose to dismount there to stay closer to shore. On the second leg, riders are further away from shore and moving in a direction mostly parallel to the line of incoming surf (given conditions such as typical ocean currents and wave direction), which can offer interesting surfing opportunities when riders dismount with their surfboards ready for use. The third leg of the exemplary arrangement illustrated in FIG. 1 has riders moving more directly with incoming surf and can offer its own opportunities for a varied surfing experience.

Changing conditions, e.g., surf incoming from a different direction, can potentially make the second and third legs exchange characteristics. In environments where the direction of incoming surf is unlikely to have any significant variation, the arrangement of different legs between opposing pylons can be determined prior to construction to optimize desired characteristics for each leg.

Pylons 124, 126 are placed to allow cable 102 to form an angle with the shoreline. In such a configuration, riders dismounting from their supports are unlikely to interfere with each other. If the surf is moving perpendicular to shore, for example, even two riders dismounting at the same time will be displaced from each other laterally along the shoreline. If two riders dismount at the same place, on the other hand, one will be on a different wave from the other. If the surf is angled so as to match one of the legs of the path of cable 102, the triangular configuration shown in FIG. 1 will still offer two legs on which it is safe to dismount, even with many surfers on adjacent supports.

Large hollow arrows illustrated in FIGS. 1–2 depict the motion of rider supports and riders around the loop formed by circulating lift cable 102. In some embodiments, the direction of the cable can be switched by the operator, such as to adjust for sea conditions. In typical installations, the motion is preferably at a speed in a range similar to but not limited to that of ski lifts, about 2–10 meters per second. FIG. 2 schematically illustrates a driving wheel 212 of opposing pylon 122 without showing any structure for imparting torque to wheel 212. Any suitable type of prime mover can be employed, e.g., an electric motor near wheel 212 or at the base of mast 214 with a drive shaft inside mast 214.

Figure 3:
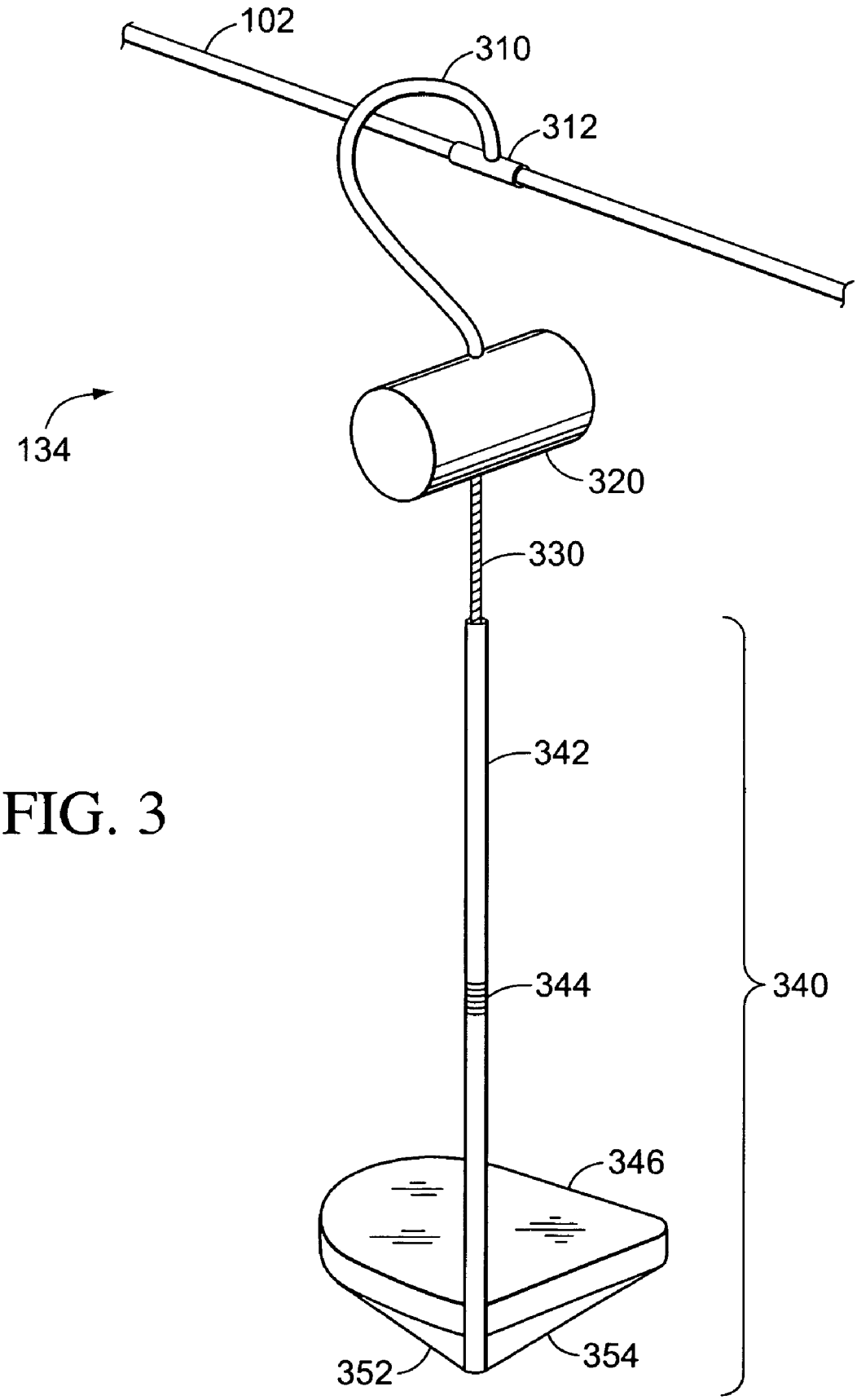
FIG. 3 is a perspective view of one of the rider supports useful with embodiments of the invention, including the exemplary systems of FIGS. 1–2.

Various particular features of exemplary surfer lift system 100 may be better understood with reference to the labeled paragraphs below. In variations where the benefits of these particular features are not required, they may be suitably omitted or modified while retaining the benefits of the various aspects of the invention discussed above. Structural elements not introduced with a reference numeral are generally not illustrated in the drawings. Those structural features referenced by number are illustrated in FIG. 3 unless otherwise indicated.

SUPPORT PYLONS—Opposing pylons 122, 124, 126 must remain upright in the face of substantial tension on lift cable 102. Guy wires can be employed to reduce structure requirements for the pylons themselves, but such wires can be unsightly and dangerous to watercraft and people around pylons 124, 126, which extend from water 112. To be self-supporting without guy wires, opposing pylons should be of hollow steel, reinforced concrete, or solid wood construction with dimensions and strength comparable to that found in the supports for ski lifts and overhead electrical transmission lines.

Intermediate support pylons 123, 125, 127 are located between opposing pylons and are not subject to as much lateral forces as the main opposing pylons, but both types of pylons need to support a considerable amount of downward force and withstand storm-driven wind and wave action. Anchor points for the pylons should be substantial enough (e.g., mast ends embedded in concrete blocks) and deep enough beneath the surface of the beach or seabed to ensure adequate structural integrity.

LIFT CABLE—The system described above involves a lift cable, such as cables 102 or 402/404, which move around the support pylons. Alternatively, the lift cable may be fixed, but the seating platforms movable along the cables. In the embodiment of FIG. 3, for example, pressure sleeve 312 can instead have powered wheels or ball bearings allowing seating platform 340 to travel along fixed cable 102.

SEATING PLATFORM—Instead of employing variable-length suspension cable 330, a seating platform can move up and down on a fixed length of vertical suspension cable. For example, a movable seat can straddle the suspension cable, supported from a desired point along its length by opposing wheels in snug, frictional contact with opposite sides of it. Such a seat should be designed with care, however, with consideration given to the closeness of the fabric of a rider's swimsuit or fingers to the point of relative motion between the fixed suspension cable and the seat.

WINCH—One of many possible variations for powering winch 320 is a miniature internal combustion engine. Another is a tension-storing spring whose rotation is held in check by a brake, similar to the mechanism employed in retractable tape measures. Such a spring can be configured to controllably unwind under the tension developed by the expected weight of a rider, with a manually controlled reduction or elimination of braking. It can be configured to wind back up again when that weight is removed, preferably at a reasonable speed maintained by controlled, automatic application of the brake.

WINCH CONTROL—Winch 320 can be controlled by an onshore operator, either additionally to the rider controls or in place of them. An additional or alternative control system for winch 320 can automatically raise platform 340, temporarily, when platform 340 passes over an obstacle or the shoreline itself, thus avoiding injuring the rider. Such a control system can also be employed to put platform 340 at a predetermined standard distance below lift cable 102, consistent with any embarkation location of system 100, as it approaches a point where people embark onto the platforms.

In other variations, seating platforms can move automatically to a first height relative to the cable when the rider enters the water and to a second height relative to the cable when approaching the embarkation point. The heights of empty seating platforms might vary automatically, depending in part on clearances, in a manner that differs when above water as compared to above the beach, or that differs when passing certain obstacles, such as rocks, currents, piers, jetties, or boat lanes.

An alternative automatic control system for winch 320 can automatically detect water level and maintain the height of platform 340 at a fixed or adjustable distance above the water, e.g., a preset or adjustable distance above the actual wave height, the average water height, or the highest expected wave crests. Thus, the "raised" and "lowered" positions of riders' support points can be varied to match the current sea level resulting from tidal conditions. Safety considerations may make it desirable to limit the maximum height of riders above wave crests, for example.

In another variation, the control system can be further configured to increase the distance between platform 340 and its point of attachment with lift cable 102 while the rider is embarking on to platform 340. By doing so at a steady, controlled pace, the control system permits the platform to move more slowly than the circulation of lift cable 102, or even remain stationary for a short time. Thus, stress and danger to the person being seated on platform 340 is reduced. The control system can "take back" the distance it has added between platform 340 and the point of attachment with lift cable 102 once platform 340 has left the embarkation station or location.

Descent control 344 can be restricted in operation to certain parts of the cycle around the loop traveled by cable 102. For example, the control may be set to work only when the rider is more than a certain distance offshore and away from known obstacles. In other variations, descent control 344 can be restricted to limit the heights to which the rider can control the seating platforms. For example, the rider can be restricted from lowering the seating platform in dangerous ways, either at certain points around the loop traveled by the cable, such as when passing obstacles, or at any point around the loop, such as to prevent the rider from lowering or raising the seating platform dangerously. Such optional additional systems can be combined together, e.g., system 100 can carry platform 340 at a certain distance above the highest waves, raise and lower it to avoid obstacles automatically, and still allow the rider to descend at any desired time while passing through a particular part of the path.

SUSPENSION CABLE—For safety and corrosion resistance, cable 330 should have a plastic coating. Alternatively, rope of suitable strength and wear resistance that is not adversely affected by contact with seawater can be employed instead of steel cable. The aperture of the housing of winch 320, or whatever uncovered point at which a suspension cable begins winding onto an uncovered winch, should be out of reach of the fingers or hair of any riders seated on platform 340.

SURFBOARD—Riders can dismount from a seating platform and surf waves in other ways than with standard surfboards. For example, shortened "boogie boards," miniaturized personal powered watercraft, windsurfers, or no device at all (bodysurfing) can be employed after use of surf lift system 100. Structure can be included, e.g., a rack on one side of the seating platform, to hold the rider's chosen device so that he or she doesn't need to carry it during transit to the point of dismounting and entering the water.

Public Notice Regarding The Scope Of The Invention and Claims

No one embodiment disclosed herein is essential to the practice of another unless indicated as such. Indeed, the invention, as supported by the disclosure above and in the originally filed claims, includes all systems and methods that can be practiced from all suitable combinations of the various aspects disclosed, and all suitable combinations of the exemplary elements listed. Such combinations have particular advantages, including advantages not specifically recited herein.

Alterations and permutations of the preferred embodiments and methods will become apparent to those skilled in the art upon a reading of the specification and a study of the drawings.

Accordingly, none of the disclosure of the preferred embodiments and methods defines or constrains the invention. Rather, the issued claims variously define the invention. Each variation of the invention is limited only by the recited limitations of its respective claim, and equivalents thereof, without limitation by other terms not present in the claim.

In addition, aspects of the invention are particularly pointed out below using terminology that the inventor regards as having its broadest reasonable interpretation; the more specific interpretations of 35 U.S.C. § 112(6) are only intended in those instances where the terms "means" or "steps" are actually recited. For example, claim terminology calling for a seat to be connected to the loop via a "variable length" of vertical suspension cable is not restricted to implementations where the overall length of the vertical suspension cable is variable, e.g., with a winch, but also reads on implementations where the length of cable actually making the connection is varied. For example, an embodiment of the invention where the seat itself moves up and down on a vertical suspension cable of fixed length is nonetheless connected to the loop via a variable length of that cable.

The words "comprising," "including," and "having" are intended as open-ended terminology, with the same meaning as if the phrase "at least" were appended after each instance thereof. A clause using the term "whereby" merely states the result of the limitations in any claim in which it may appear and does not set forth an additional limitation therein. The conjunction "or" between alternative elements means "and/or," and thus does not imply that the elements are mutually exclusive unless context or a specific statement indicates otherwise.

What is claimed is:

1. A surfer lift method comprising:

(a) suspending a rider a first, default distance beneath a lift cable;

(b) moving the rider over a region of water with incoming waves;

(c) controllably increasing the distance that the rider is suspended beneath the lift cable to a second distance that is greater than the first distance; and (d) thereafter, having the rider enter the water.

2. The method of claim 1 wherein controllably increasing the suspension distance comprises having the rider control the increase thereof.

3. The method of claim 1 wherein the first, default distance is small enough to have the rider pass over the crests of waves of expected height.

4. The method of claim 3 further comprising suspending a plurality of riders at individually controllable distances beneath the lift cable and wherein controllably increasing the suspension distance, for at least some of the plurality of riders, comprises increasing the suspension distance to a second distance that is just less than the distance between the lift cable and the water at a trough between two waves where the rider enters the water.

5. The method of claim 1, wherein controllably increasing the suspension distance comprises lowering a seat supporting the rider without changing the orientation of the seat with respect to the cable.

6. The method of claim 1 wherein moving the rider comprises circulating the lift cable around a plurality of pylons in a continuous loop that extends at least partially over the region of water.

7. The method of claim 6 wherein the plurality of pylons consists of four opposing pylons.

8. The method of claim 7 wherein circulating the lift cable in a continuous loop comprises moving the cable around each of two of the pylons, which act as ends of the loop, and moving opposite sides of the looped cable in opposite directions as they pass each of the other two of the pylons.

9. The method of claim 8:

(a) wherein controllably increasing the suspension distance comprises having the rider individually control the increase thereof; and (b) further comprising allowing the rider individually to control the suspension distance in two directions, to increase or decrease it.

10. The method of claim 9 further comprising:

(a) suspending a plurality of riders at individually controllable distances beneath the lift cable; and (b) before suspending a given one of the riders beneath the lift cable, having that rider wait at a raised platform beneath the lift cable.

11. A surfer lift apparatus comprising:

(a) a cable arranged in a loop extending at least partially over a region of water and supported by each of a plurality of pylons; and (b) a plurality of seats that can travel around the loop and are each suspended from the cable via a variable-length support at a default distance below the cable;

(c) wherein, for each of a plurality of the seats, the variable-length support can at least increase from the default distance, to move the seat in a downward direction from the cable.

12. The apparatus of claim 11 further comprising, for each of the seats, a control structured to be manipulated by a rider to control movement of the seat.

13. The apparatus of claim 11 further comprising an embarkation platform beneath the cable at a place along the loop.

14. The apparatus of claim 11 wherein the cable circulates around the pylons, thereby causing the seats to travel around the loop.

15. The apparatus of claim 14 wherein the plurality of pylons consists of four pylons.

16. The apparatus of claim 15 wherein the lift cable is arranged in a loop whose ends pass around each of two of the pylons and whose middle passes in both directions around each of the other two pylons.

17. The apparatus of claim 11 further comprising:

(a) an embarkation platform beneath the cable at a place along the loop; and (b) for each of the seats, a control structured to be manipulated by a rider to control movement of the seat in both an upward and a downward direction;

(c) wherein the default distance is small enough to allow the seat to pass over the crests of waves of expected height;

(d) wherein the seat can be lowered to a point that is below the peak of at least one wave; and (e) wherein the seat does not change its orientation with respect to the lift cable as a result of being lowered.

18. A surfing method comprising:

(a) sitting on a seat that is suspended from a lift cable at a first, default distance;

(b) traveling on the seat to a chosen place over a body of water;

(c) near the chosen place, lowering the seat with respect to the lift cable to a second distance greater than the first distance, with the seat remaining suspended from the lift cable; and (d) then entering the water.

19. The method of claim 18 further comprising, after part (d), surfing a wave in the water.

20. The method of claim 19 further comprising, before part (a), standing on a platform beneath the lift cable and wherein:

(i) the first, default distance is small enough to allow the seat to pass over the crests of waves of expected height;

(ii) part (b) comprises adjusting the seat from the first, default distance, as desired, either up or down from the default distance;

(iii) part (c) comprises increasing the suspension distance to a second distance that is greater than the distance between the lift cable and the water at the peak of a wave adjacent to the point where the seat is lowered; and (iv) part (c) further comprises lowering the seat without changing the orientation of the seat with respect to the lift cable.

* * * * *